US009149692B2

(12) United States Patent
Shimahara

(10) Patent No.: US 9,149,692 B2
(45) **Date of Patent: *Oct. 6, 2015**

(54) GOLF CLUB HEAD

(71) Applicant: DUNLOP SPORTS CO. LTD., Kobe-shi, Hyogo (JP)

(72) Inventor: Yuki Shimahara, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 187 days.

This patent is subject to a terminal disclaimer.

(21) Appl. No.: 13/872,533

(22) Filed: Apr. 29, 2013

(65) Prior Publication Data

US 2013/0288820 A1 Oct. 31, 2013

(30) Foreign Application Priority Data

Apr. 30, 2012 (JP) ..... 2012-104280

(51) Int. Cl.
*A63B 53/04* (2015.01)

(52) U.S. Cl.
CPC ..... *A63B 53/04* (2013.01); *A63B 53/047* (2013.01); *A63B 53/0466* (2013.01); *A63B 53/0487* (2013.01); *A63B 2053/0408* (2013.01); *A63B 2053/0445* (2013.01); *A63B 2225/60* (2013.01)

(58) Field of Classification Search
CPC ..... A63B 53/04; A63B 2053/0445; A63B 53/0487; A63B 53/0466; A63B 53/047; A63B 2225/60; A63B 2053/0408
USPC ..... 473/324–350, 287–292; D21/759
See application file for complete search history.

(56) References Cited

U.S. PATENT DOCUMENTS

| | | | | |
|---|---|---|---|---|
| 5,437,088 | A * | 8/1995 | Igarashi | 29/527.6 |
| D570,934 | S * | 6/2008 | Ban et al. | D21/744 |
| 7,540,810 | B2 * | 6/2009 | Hettinger et al. | 473/331 |
| 7,674,188 | B2 * | 3/2010 | Ban | 473/330 |
| 7,677,990 | B2 * | 3/2010 | Ban | 473/331 |
| 7,901,297 | B2 * | 3/2011 | Ban et al. | 473/331 |
| 8,012,036 | B2 * | 9/2011 | Nakamura | 473/290 |
| 8,128,513 | B2 * | 3/2012 | Gilbert et al. | 473/330 |
| 8,287,401 | B2 * | 10/2012 | Tateno et al. | 473/331 |
| 8,337,324 | B2 * | 12/2012 | Sander et al. | 473/330 |
| 8,684,861 | B2 * | 4/2014 | Carlyle et al. | 473/331 |
| 8,827,832 | B2 * | 9/2014 | Breier et al. | 473/331 |
| 8,858,361 | B2 * | 10/2014 | Ripp et al. | 473/331 |

(Continued)

FOREIGN PATENT DOCUMENTS

| | | | |
|---|---|---|---|
| JP | 9-253250 | A | 9/1997 |
| JP | 2002-153575 | A | 5/2002 |

(Continued)

*Primary Examiner* — Sebastiano Passaniti
(74) *Attorney, Agent, or Firm* — Birch, Stewart, Kolasch & Birch, LLP

(57) ABSTRACT

A head 2 has a face 4. The face 4 has a plurality of score line grooves 8 and a plurality of fine grooves 10. A depth of fine groove 10 is less than 0.03 mm. A width of the fine groove 10 is 0.1 mm or greater and 0.3 mm or less. A pitch of the fine groove 10 is 0.3 mm or greater and 0.8 mm or less. The fine groove 10 has a first direction extending part d1 extending in a first direction and a second direction extending part d2 extending in a second direction. The first direction is a direction directed to a top blade side toward a heel side. The second direction is a direction directed to the top blade side toward a toe side. The score line groove 8 and the fine groove 10 do not cross each other.

18 Claims, 15 Drawing Sheets

(56) References Cited

U.S. PATENT DOCUMENTS

| | | | | |
|---|---|---|---|---|
| 2006/0025233 | A1* | 2/2006 | Lin | 473/330 |
| 2008/0020859 | A1 | 1/2008 | Yamagishi et al. | |
| 2008/0125242 | A1 | 5/2008 | Ban | |
| 2009/0176597 | A1 | 7/2009 | Yamagishi et al. | |
| 2009/0312116 | A1 | 12/2009 | Ban | |
| 2010/0087270 | A1 | 4/2010 | Ban et al. | |
| 2010/0261545 | A1 | 10/2010 | Ban | |
| 2011/0081985 | A1 | 4/2011 | Yamagishi et al. | |
| 2011/0086725 | A1 | 4/2011 | Yamagishi et al. | |
| 2011/0269567 | A1 | 11/2011 | Ban et al. | |
| 2011/0269568 | A1 | 11/2011 | Ban | |
| 2013/0053171 | A1* | 2/2013 | Carlyle et al. | 473/331 |
| 2013/0225319 | A1* | 8/2013 | Kato | 473/331 |

FOREIGN PATENT DOCUMENTS

| | | | |
|---|---|---|---|
| JP | 2007-202633 | A | 8/2007 |
| JP | 2008-272271 | A | 11/2008 |

* cited by examiner

GOLF CLUB HEAD

The present application claims priority on Patent Application No. 2012-104280 filed in JAPAN on Apr. 30, 2012, the entire contents of which are hereby incorporated by reference.

BACKGROUND OF THE INVENTION

1. Field of the Invention

The present invention relates to a golf club head having a score line groove.

2. Description of the Related Art

A score line groove is formed on many golf club heads. The score line groove can contribute to an increase in a backspin rate.

Japanese Patent Application Laid-Open No. 9-253250 discloses a head having a small groove formed on a face surface. The small groove is formed by utilizing a cutting trace when forming the face surface.

Japanese Patent Application Laid-Open No. 2002-153575 discloses a recessed part formed on a face surface by microfabrication. The depth of the recessed part is 5 to 10 μm, and the width of the recessed part is 5 to 20 μm.

Japanese Patent Application Laid-Open No. 2007-202633 discloses a head having a small groove formed on a face part. The small groove has an opening width and a depth less than those of a score line.

Japanese Patent Application Laid-Open No. 2008-132168 (US2008/0125242, US2009/0312116, US2010-0261545) discloses a head including a plurality of score line grooves and a plurality of thin grooves. An angle between the thin groove and the score line groove is set to 40 degrees or greater and 70 degrees or less as viewed clockwise from the toe side of the score line groove.

Japanese Patent Application Laid-Open No. 2010-88678 (US2010-0087270) discloses a head including a plurality of thin grooves extending to a heel side from a toe side.

Japanese Patent Application Laid-Open No. 2011-234748 (US2011-0269568) discloses a head having thin groove formed parallel to score line in each region between the adjacent score lines.

Japanese Patent Application Laid-Open No. 2011-234749 (US2011-0269567) discloses a head having a plurality of score lines, a first thin groove, and a second thin groove formed on a face surface. The first thin groove is parallel to the score line. The second thin groove crosses the score line.

Japanese Patent Application Laid-Open No. 2008-23178 (US2008/0020859, US2009/0176597, US2011-0081985, US2011-0086725) discloses a face surface having a circular cutting trace formed by mealing processing, and an S-shaped cutting trace.

Japanese Patent Application Laid-Open No. 2008-272271 discloses many small groove lines which are shallower than a score line groove and have a width narrower than that of the score line groove. The gazette discloses that the small groove lines are curves protruded to a top side.

SUMMARY OF THE INVENTION

For example, in golf in rainy weather, an impact is performed in a state where water exists between a face and a ball. The water can decrease friction between the face and the ball. A backspin rate may be decreased by the reduction in the friction. It is preferable that good backspin is obtained in various situations.

It is an object of the present invention to provide a golf club capable of obtaining good backspin.

Ahead according to the present invention includes a face. The face has a plurality of score line grooves, a plurality of fine grooves, and a land area. A depth of the fine groove is less than 0.03 mm. A width of the fine groove is 0.1 mm or greater and 0.3 mm or less. A pitch of the fine groove is 0.3 mm or greater and 0.8 mm or less. The fine groove has a first direction extending part extending in a first direction and a second direction extending part extending in a second direction. The first direction is a direction directed to a top blade side toward a heel side. The second direction is a direction directed to the top blade side toward a toe side. The score line groove and the fine groove do not cross each other.

An absolute value of an angle between an extending direction of the score line groove and the first direction is defined as $\alpha$, and an absolute value of an angle between the extending direction of the score line groove and the second direction is defined as $\beta$. At this time, preferably, $\alpha \leq \beta$ is set.

Preferably, the angle $\alpha$ is 5 degrees or greater and 45 degrees or less. Preferably, the angle $\beta$ is 5 degrees or greater and 90 degrees or less.

Preferably, the fine groove consists of the first direction extending part and the second direction extending part. Preferably, an angle $\theta$ between the first direction and the second direction is 45 degrees or greater and 170 degrees or less.

Preferably, the fine grooves do not cross each other.

Preferably, the golf club head further includes a round part connecting the first direction extending part to the second direction extending part.

An area of a portion sandwiched by the plurality of score line grooves is defined as Sa, and an area of the fine groove is defined as Sb. Preferably, Sb/Sa is 0.14 or greater and 0.44 or less.

Preferably, the fine groove is formed by a laser.

Good backspin can be obtained.

DESCRIPTION OF THE PREFERRED EMBODIMENTS

Hereinafter, the present invention will be described in detail based on preferred embodiments with appropriate reference to the drawings.

Figure 1:
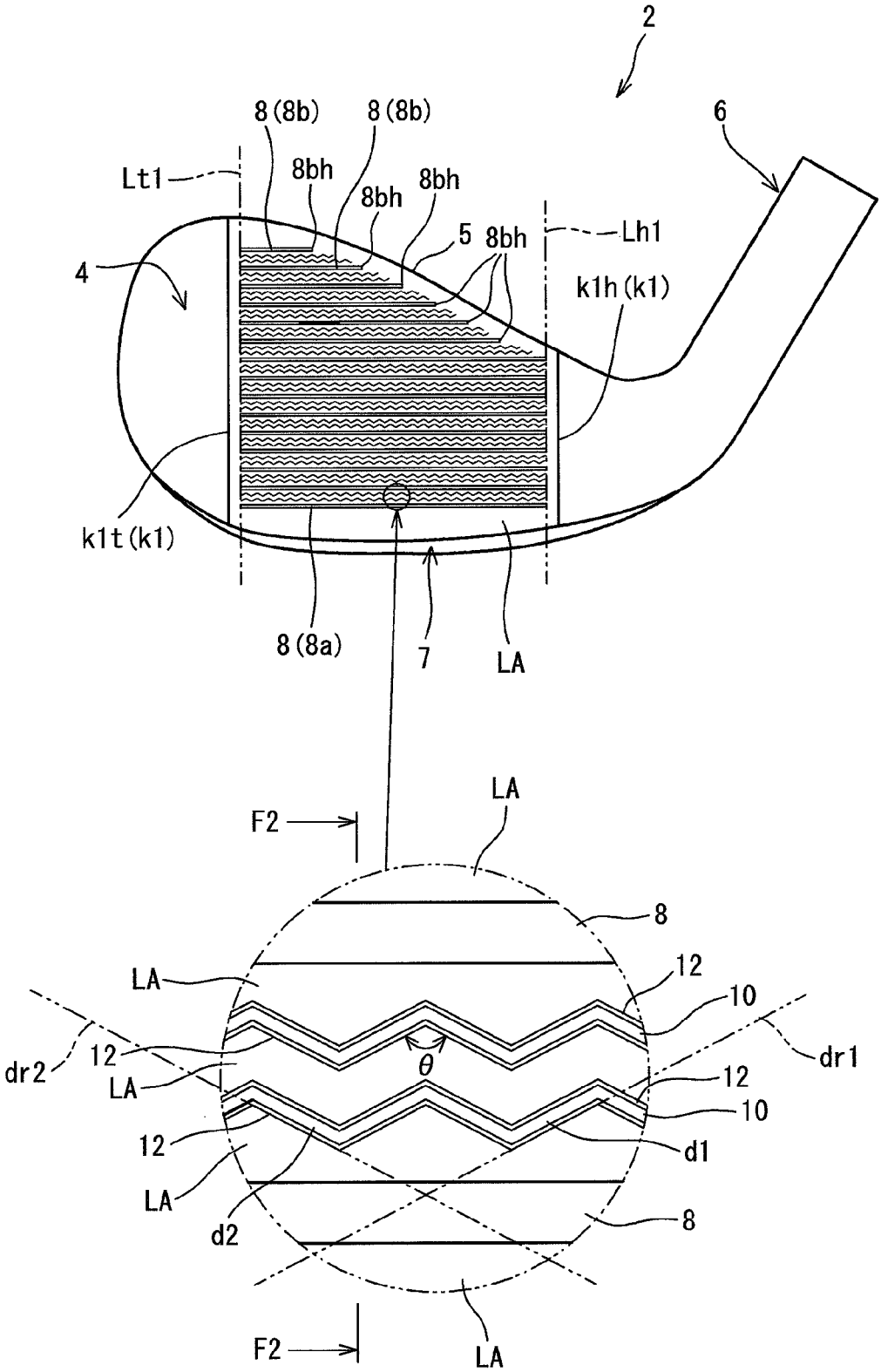
FIG. 1 is a front view of a golf club head according to a first embodiment of the present invention.
Figure 2:
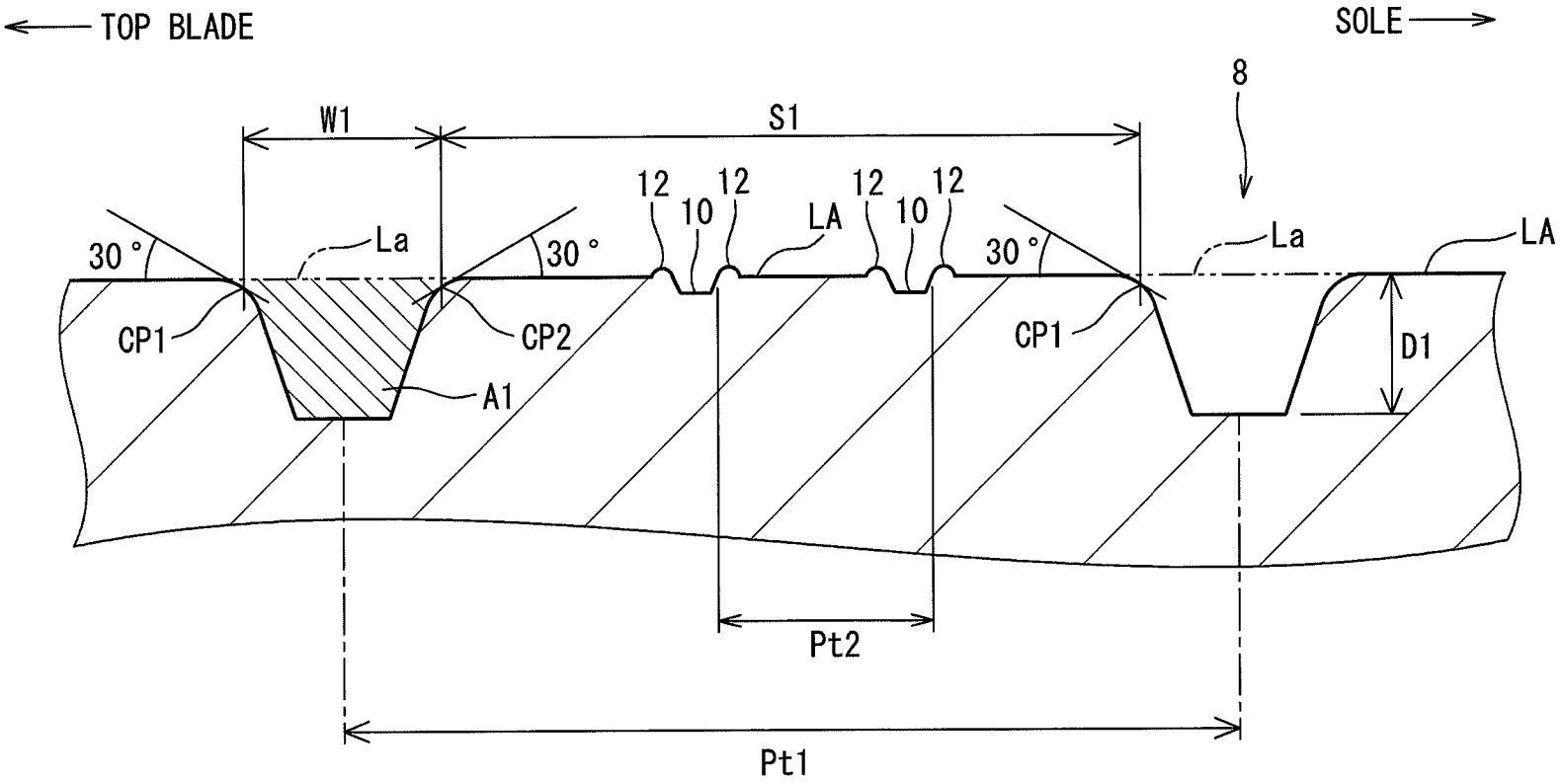
FIG. 2 is a cross-sectional view taken along line F2-F2 of FIG. 1.
Figure 3:
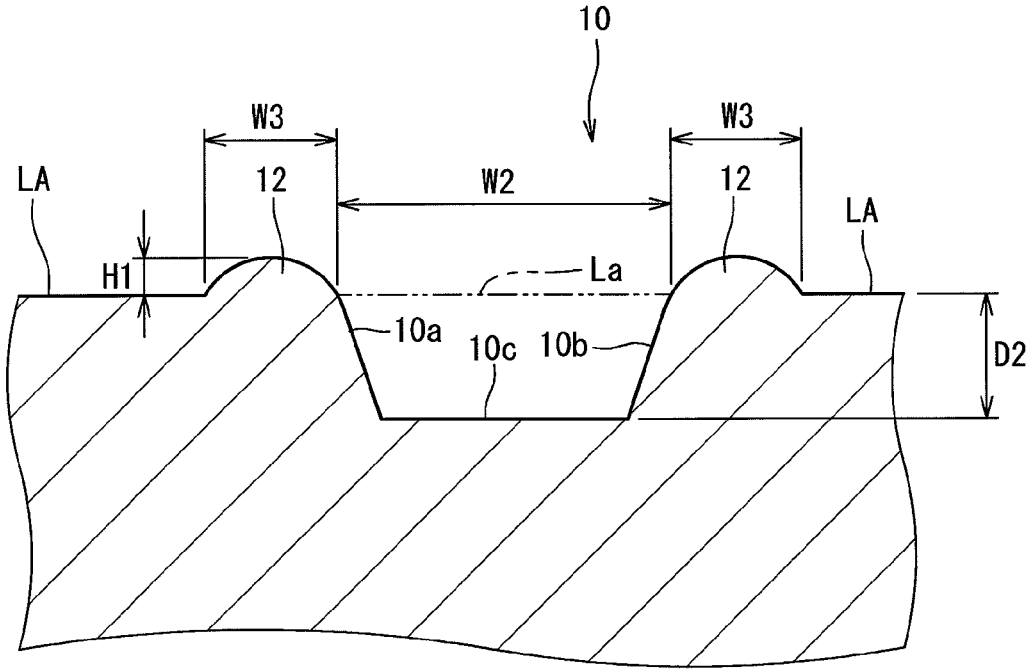
FIG. 3 is an enlarged view of a fine groove in FIG. 2.

A head 2 shown in FIG. 1 is placed at a predetermined lie angle and real loft angle on a level surface. FIG. 2 is a cross-sectional view taken along line F2-F2 of FIG. 1. FIG. 3 is an enlarged cross-sectional view of the vicinity of a fine groove 10 (to be described later).

The golf club head 2 is a so-called iron type of golf club head. The head is also referred to as an iron head. The head is for right-handed golf players. The golf club head 2 is a so-called wedge. The real loft angle of the wedge is usually 43 degrees or greater and 70 or less. The embodiment is particularly effective in an approach shot. In this respect, the real loft angle of the head 2 is preferably equal to or greater than 43 degrees, more preferably equal to or greater than 45 degrees, still more preferably equal to or greater than 48 degrees, and yet still more preferably equal to or greater than 50 degrees.

The head 2 has a face 4, a top blade 5, a hosel 6, and a sole 7. The face 4 has a score line groove 8 formed thereon. The golf club head 2 has a shaft hole (not shown) to which a shaft is mounted. The shaft hole is formed in the hosel 6.

The materials of the head 2 and the face 4 are not limited. The face 4 may be a metal, or may be a nonmetal. Examples of the metal include iron, stainless steel, maraging steel, pure titanium, and a titanium alloy. Examples of the iron include soft iron (low carbon steel having a carbon content of less than 0.3 wt %). Examples of the nonmetal include CFRP (carbon fiber reinforced plastic).

The head 2 has the plurality of score line grooves 8. The score line grooves 8 have a longest line 8*a* having a longest length and a non-longest line 8*b* shorter than the longest line 8*a*. As shown in FIG. 1, the length of the non-longest line 8*b* is shorter toward a top blade side.

As shown in FIG. 1, the toe side ends of the longest lines 8*a* are substantially located on one straight line Lt1. The heel side ends of the longest lines 8*a* are substantially located on one straight line Lh1.

The face 4 has a land area LA. The land area LA indicates a plane portion of the surface of the face 4 (face surface) on which the grooves are not formed. If minute unevenness formed by a shot-blasting treatment (to be described later) is disregarded, the land area LA is substantially a plane. Therefore, in the embodiment, the land area LA is regarded as a plane.

A part of the face 4 is subjected to a treatment for adjusting a surface roughness. The typical example of the treatment is the shot-blasting treatment. A boundary line k1 between an area which is subjected to the shot-blasting treatment and an area which is not subjected to the shot-blasting treatment is shown in FIG. 1. An area between a toe side boundary line kit and a heel side boundary line k1*h* is subjected to the shot-blasting treatment. As shown in FIG. 1, the boundary line kit and the boundary line k1*h* are substantially parallel. All the score line grooves 8 are formed in the area which is subjected to the shot-blasting treatment. An area located on the toe side of the toe side boundary line k1*t* is not subjected to the shot-blasting treatment. An area located on the heel side of the heel side boundary line k1*h* is not subjected to the shot-blasting treatment. The toe side boundary line kit and the heel side boundary line k1*h* are visually recognized by the absence or presence of the shot-blasting treatment. The shot-blasting treatment increases the surface roughness. The increased surface roughness can increase the backspin rate of a ball. The increase in the backspin rate tends to cause a ball to stop the ball near the point of fall. The increase in the backspin rate can make it easy to stop the ball at the aiming point. The increase in the backspin rate is particularly useful for a shot targeting a green and an approach shot.

The face surface may be polished before the score line grooves 8 are formed. The face surface of the head before the score line grooves 8 are formed can be smoothed by polishing the face surface. The polishing of the face surface can contribute to the flush land area LA. Therefore, the directivity of a hit ball can be improved.

Before the score line grooves 8 are formed, a treatment (the shot-blasting treatment described above, or the like) for adjusting the surface roughness may be performed. After the score line grooves 8 are formed, the treatment for adjusting the surface roughness may be performed.

The face 4 has the fine groove 10 (see an enlarged part of FIG. 1, and FIGS. 2 and 3). In the present application, the fine groove 10 is a groove different from the score line groove 8. A width W2 of the fine groove 10 is narrower than a width W1 of the score line groove 8. The fine groove 10 is disposed between the score line grooves 8 adjacent to each other. In the embodiment, two fine grooves 10 are formed between the score line grooves 8 adjacent to each other. The fine groove 10 extends in a curved manner. The fine groove 10 is curved zigzag.

As shown in FIG. 3, the fine groove 10 has a side surface 10*a* located on the top blade side, a side surface 10*b* located on a sole side, and a bottom surface 10*c*. The bottom surface 10*c* is a plane parallel to the land area LA. The bottom surface 10*c* may not exist. The cross-sectional shape of the fine groove 10 may not be symmetrical as shown in FIG. 3. Each of the side surfaces 10*a* and 10*b* and the bottom surface 10*c* may not be plane. Although the cross-sectional shape of a protruded part 12 is a circular arc shape in the drawings of the present application, actually, the cross-sectional shape of the protruded part 12 may not be the circular arc shape. When the fine groove 10 is particularly manufactured by a method to be described later, usually, the cross-sectional shape of the protruded part 12 is not a balanced shape as shown in FIG. 3.

The face 4 of the embodiment has the protruded part 12 (see the enlarged part of FIG. 1, and FIGS. 2 and 3). The protruded part 12 is in a stripe form. The protruded part 12 extends along the fine groove 10. The protruded part 12 is curved zigzag. The protruded part 12 is protruded beyond the land area LA. Of course, the protruded part 12 may not exist.

The protruded part 12 is adjacent to the fine groove 10. The land area LA does not exist between the protruded part 12 and the fine groove 10. The side surface 10*a* of the fine groove 10 and the outer surface of the protruded part 12 are continuous.

The protruded parts 12 are provided on the top blade 5 side and sole 7 side of the fine groove 10. The protruded parts 12 are provided on both the sides of the fine groove 10.

The backspin rate can be increased by forming the fine groove 10 in addition to the score line groove 8. Furthermore, the backspin rate can be increased by providing the protruded part 12.

The protruded part 12 is adjacent to the fine groove 10. Therefore, the same effect as that of the increased depth D2 of the fine groove 10 is generated by the protruded part 12. The backspin rate can be increased by a synergistic effect of the fine groove 10 with the protruded part 12.

The fine groove 10 has a first direction extending part d1 and a second direction extending part d2. The first direction extending part d1 is a direction along a straight line. The second direction extending part d2 is a direction along a straight line.

As shown in the enlarged part of FIG. 1, the extending direction (first direction dr1) of the first direction extending part d1 is a direction directed to the top blade side toward the heel side. The first direction dr1 is inclined with respect to the score line groove 8.

As shown in the enlarged part of FIG. 1, the extending direction (second direction dr2) of the second direction extending part d2 is a direction directed to the top blade side toward the toe side. The second direction dr2 is inclined with respect to the score line groove 8.

The inclination directions of the first direction extending part d1 and second direction extending part d2 with respect to the score line groove 8 are opposite to each other.

All the fine grooves 10 are located between the score line grooves 8 adjacent to each other. The score line groove 8 and the fine groove 10 do not cross each other. Therefore, any fine grooves 10 do not eliminate the edge of other fine grooves 10.

Figure 4:
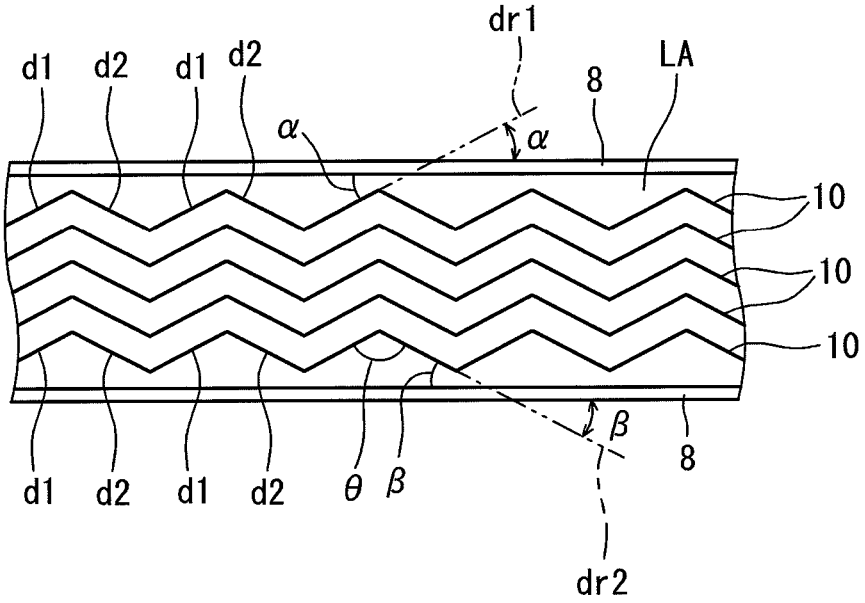
FIG. 4 is a partial enlarged view of a face surface of a second embodiment.

FIG. 4 shows a fine groove 10 of a head according to a second embodiment. The difference between the head according to the second embodiment and the head 2 described above is only the number of the fine grooves 10. In the embodiment of FIG. 4, five fine grooves 10 are formed between two adjacent score line grooves 8. In the embodiment, the length of a first direction extending part d1 is the same as that of a second direction extending part d2. The fine grooves 10 do not cross each other. Therefore, any fine grooves 10 do not eliminate the edge of other fine grooves 10. The distances between the fine grooves 10 are the same in all positions in a toe-heel direction. In the embodiment of FIG. 4, the fine groove 10 consists of the first direction extending part d1 and the second direction extending part d2.

The fine groove 10 is briefly shown by one line in FIG. 4, and FIGS. 5 to 9 to be described later.

Figure 5:
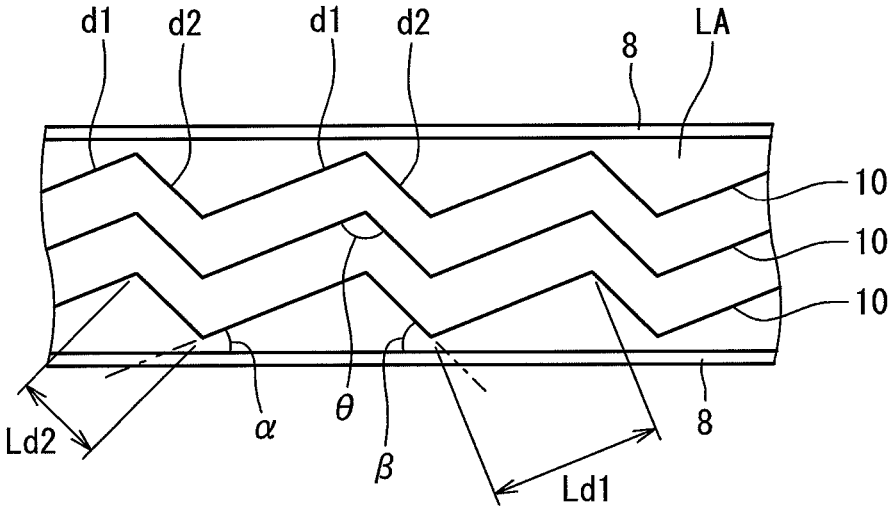
FIG. 5 is a partial enlarged view of a face surface of a third embodiment.

FIG. 5 shows a fine groove 10 of a head according to a third embodiment. The difference between the head according to the third embodiment and the head 2 described above is only the fine groove 10. In the embodiment of FIG. 5, three fine grooves 10 are formed between two adjacent score line grooves 8. In the embodiment, a length Ld1 of a first direction extending part d1 is different from a length Ld2 of a second direction extending part d2. The fine grooves 10 do not cross each other. The length Ld1 is greater than the length Ld2. The distances between the fine grooves 10 are the same in all positions in a toe-heel direction. In the embodiment of FIG. 4, the fine groove 10 consists of the first direction extending part d1 and the second direction extending part d2.

Figure 6:
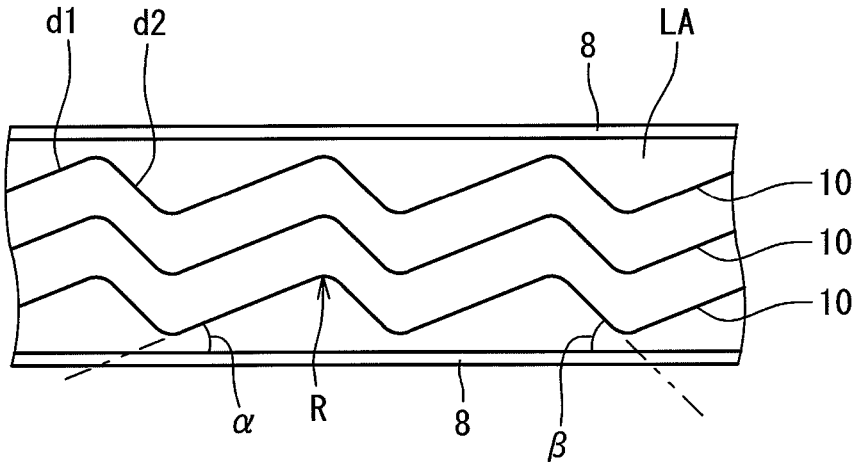
FIG. 6 is a partial enlarged view of a face surface of a fourth embodiment.

FIG. 6 shows a fine groove 10 of a head according to a fourth embodiment. The difference between the head according to the fourth embodiment and the head 2 described above is only the fine groove 10. In the embodiment of FIG. 6, three fine grooves 10 are formed between two adjacent score line grooves 8. In the embodiment, the fine groove 10 has a round part R connecting a first direction extending part d1 to a second direction extending part d2. The round part R is rounded. The embodiment of FIG. 6 is the same as that of FIG. 5 except for the existence of the round part R.

Figure 7:
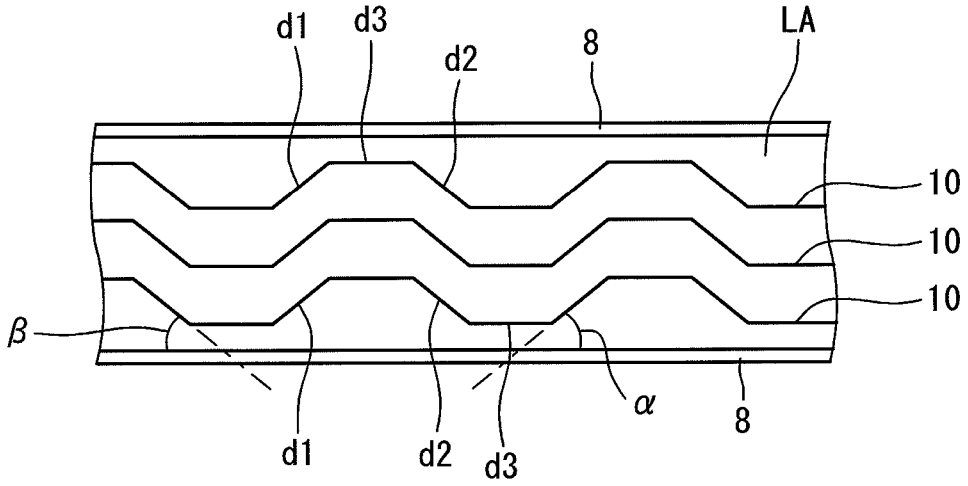
FIG. 7 is a partial enlarged view of a face surface of a fifth embodiment.

FIG. 7 shows a fine groove 10 of a head according to a fifth embodiment. The difference between the head according to the fifth embodiment and the head 2 described above is only the fine groove 10. In the embodiment of FIG. 7, three fine grooves 10 are formed between two adjacent score line grooves 8. In the embodiment, the fine groove 10 has a first direction extending part d1, a second direction extending part d2, and a third direction extending part d3. The third direction extending part d3 connects the first direction extending part d1 to the second direction extending part d2. The third direction extending part d3 is parallel to the score line groove 8.

Figure 8:
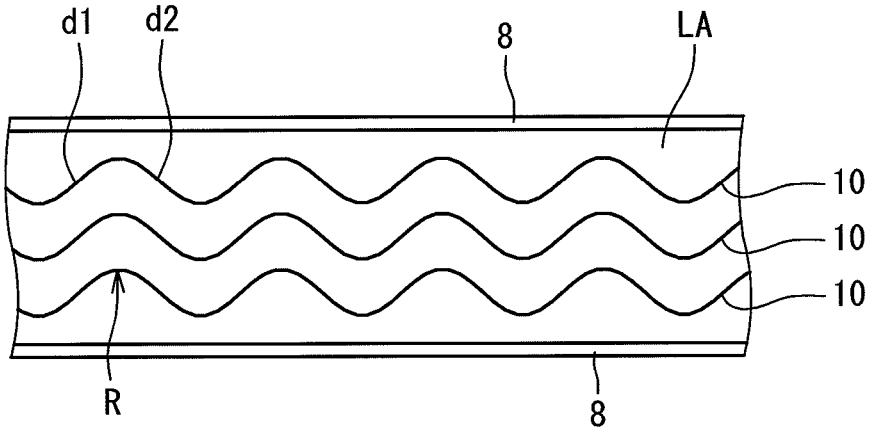
FIG. 8 is a partial enlarged view of a face surface of a sixth embodiment.

FIG. 8 shows a fine groove 10 of a head according to a sixth embodiment. The difference between the head according to the sixth embodiment and the head 2 described above is only the fine groove 10. In the embodiment of FIG. 8, three fine grooves 10 are formed between two adjacent score line grooves 8. In the embodiment, the fine groove 10 has a wave shape. The fine groove 10 has a first direction extending part d1, a second direction extending part d2, and a round part R. The distances between the fine grooves 10 are the same in all positions in a toe-heel direction.

Figure 9:
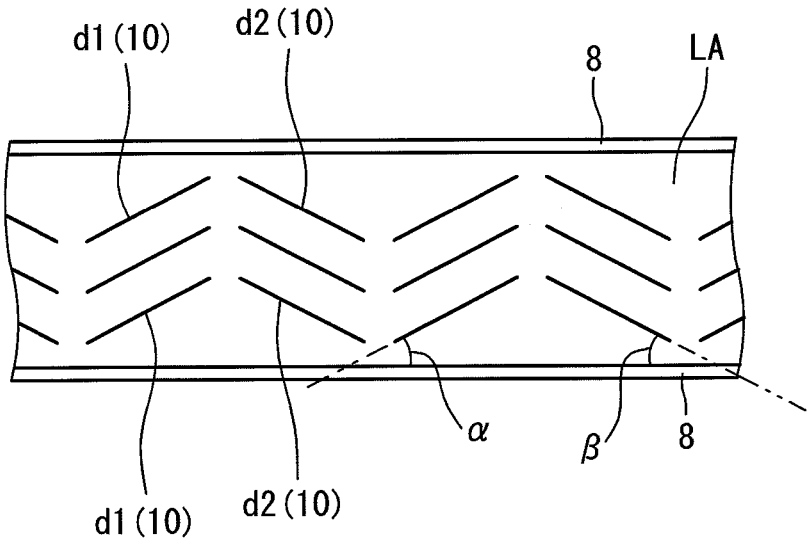
FIG. 9 is a partial enlarged view of a face surface of a seventh embodiment.

FIG. 9 shows a fine groove 10 of a head according to a seventh embodiment. The difference between the head according to the seventh embodiment and the head 2 described above is only the fine groove 10. In the embodiment, a first direction extending part d1 is separated from a second direction extending part d2. In the present invention, the first direction extending part d1 may be separated from the second direction extending part d2. In respects of the ease of the formation of the fine groove 10 and of wet spin, the first direction extending part d1 and the second direction extending part d2 are preferably connected.

[Formation Method of Score Line Groove]

A formation method of the score line groove 8 is not limited. Examples of the formation method of the score line groove 8 include forging, press processing, casting, and cut processing (carving).

In the cut processing, the cut processing of the score line groove 8 is carried out by using a cutter. In the press processing, a score line groove metal mold which has a protruded part corresponding to the shape of the score line groove 8 is used. The score line groove metal mold is forced on the face to form the score line groove 8. The score line groove metal mold in the press processing is also referred to as a "score line groove engraved mark" by a person skilled in the art.

In respect of the accuracy of the cross-sectional shape of the score line groove 8, the cut processing is preferable.

In the cut processing, the edge of the score line groove 8 is apt to be sharp. The edge is apt to damage a ball. In this respect, processing for rounding the edge may be carried out after the cut processing. Example of the processing for rounding the edge include buff and shot blasting. The buff is carried out, for example, by a wire brush. When the processing for rounding the edge is carried out after the cut processing, the variation in the cross-sectional shape of the score line groove is apt to occur. In respect of the accuracy of the cross-sectional shape, the edge is preferably rounded by the cut processing.

Preferably, an NC processing machine is used for the cut processing of the score line groove 8. NC stands for numerical control. The score line groove 8 is formed by a cutter which is axially rotated. The cutter is moved while the cutter is axially rotated. The cutter is moved based on a program stored in the NC processing machine. The score line groove 8 having a designed depth is formed in a designed position. More preferable numerical control is CNC (Computer Numerical Control).

A score line groove width is shown by a double-pointed arrow W1 in FIG. 2. A distance between the score line grooves 8 is shown by a double-pointed arrow S1 in FIG. 2. In FIG. 2, an area of a cross section of the score line groove 8 is shown by A1. The area A1 is an area of a region shown by hatching.

The groove width W1 and the groove distance S1 are measured based on the golf rules defined by R&A (Royal and Ancient Golf Club of Saint Andrews). The measuring method is referred to as "the 30 degree method of measurement". In the 30 degree method of measurement, contact points CP1 and CP2 of tangents having an angle of 30 degrees with respect to the land area LA and the groove are determined. A distance between the contact point CP1 and the contact point CP2 is defined as the groove width W1 (see FIG. 2).

The groove depth D1 described above is a distance between an extended line La of the land area LA and the lowest point of the cross section line of the groove (see FIG. 2). The groove area A1 is an area of a portion surrounded by the extended line La and the profile (cross section line) of the groove.

In respect of spin performance, the groove width W1 is preferably equal to or greater than 0.20 (mm), more preferably equal to or greater than 0.25 (mm), and still more preferably equal to or greater than 0.30 (mm). In respects of the golf rules and of suppressing reduction in a flight distance caused by an excessive spin rate, the groove width W1 is preferably equal to or less than 0.889 (mm), more preferably equal to or less than 0.85 (mm), and still more preferably equal to or less than 0.80 (mm).

The groove distance S1 is preferably set in consideration of the conformity to the golf rules. In respect of the conformity to the rules, a value obtained by dividing the area A1 by a groove pitch (groove width W1+distance S1) is preferably equal to or less than 0.003 square inches/inch (0.0762 $mm^2$/mm). In respect of the conformity to the rules, the groove distance S1 is preferably equal to or greater than three times the groove width W1. In respect of the conformity to the rules, a pitch Pt1 of the score line groove 8 is preferably 2.0 mm or greater and 4.0 mm or less.

The fine groove 10 may be formed by the same method as that of the score line groove 8. For example, the cut processing of the fine groove 10 may be carried out by the NC processing machine (CNC processing machine). The cut processing can form the fine groove 10 without forming the protruded part 12.

Preferably, the fine groove 10 is formed by a laser. The laser is suitable for heating a thin region. A groove having a small width W2 (see FIG. 3) can be formed with accuracy by the laser. The width W2 is determined based on an intersection point between the extended line La of the land area LA and the face surface (see FIG. 3). The fine groove 10 can be efficiently formed with accuracy by the laser.

[Formation Method 1 of Fine Groove and Protruded Part]

Figure 10:
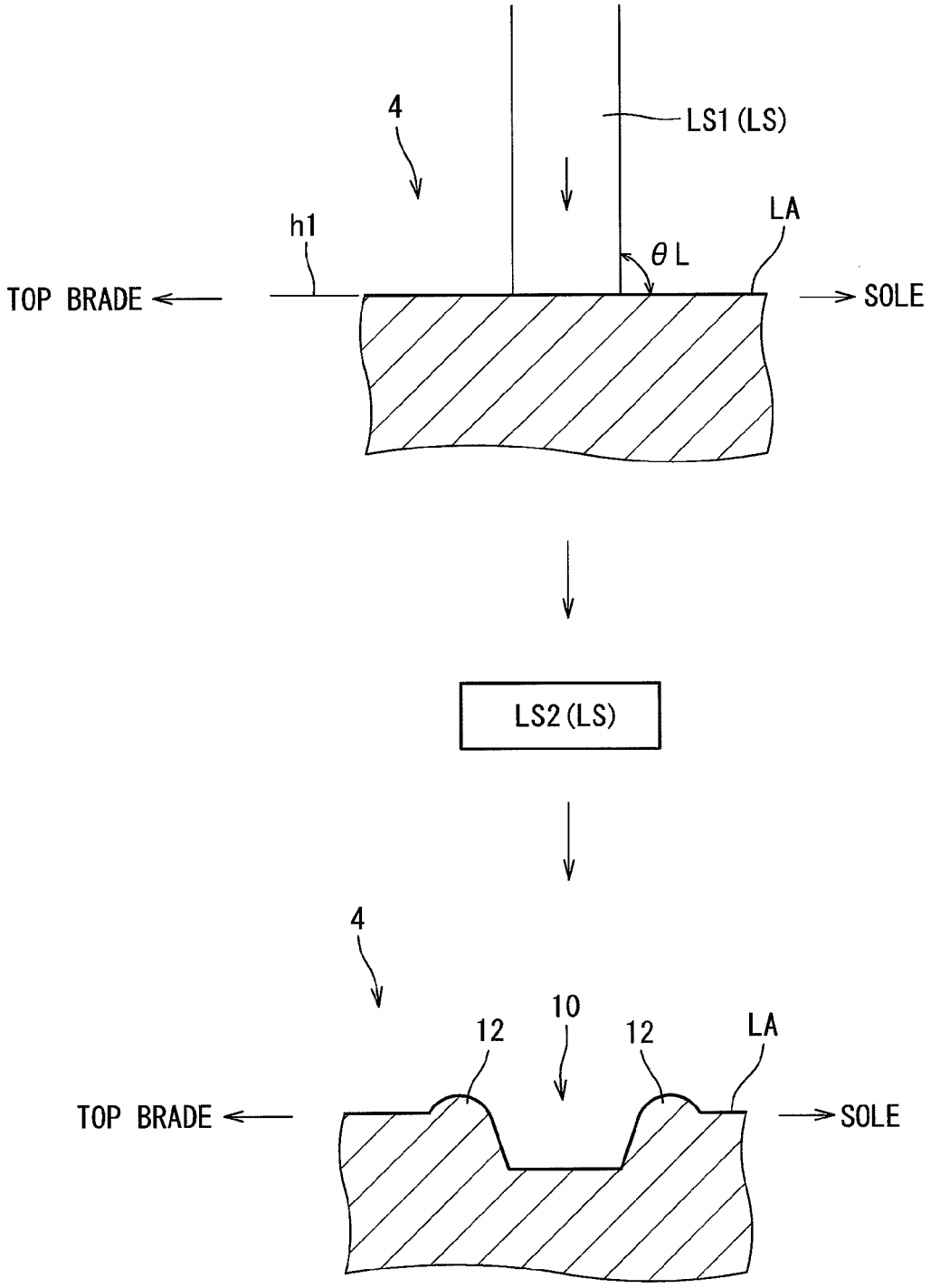
FIG. 10 describes an example of a formation method of a fine groove and a protruded part.

FIG. 10 describes an example of a preferable formation method of the protruded part 12. In the formation method, the face surface is irradiated with a laser LS. The face surface (land area LA) is irradiated with the laser LS with the face surface in a horizontal state. A laser irradiation angle θL is 90 degrees. The laser irradiation angle θL is an angle of the laser LS with respect to the face surface (land area LA) (see FIG. 10).

A portion heated by the laser LS reaches a high temperature. The portion reaching a high temperature can be melted. The melted portion can flow. A fluid is moved to both the sides of the fine groove 10 by the flow. The portion in which the protruded part 12 is formed is not irradiated with the laser LS. Therefore, the temperature of the moved fluid is lowered to solidify the fluid. The protruded part 12 is formed by the solidification. Since the method uses the laser LS, the method enables heating with high positional accuracy. The fine groove 10 and the protruded part 12 can be formed with accuracy by adjusting output of the laser, a movement speed of the laser, and the laser irradiation angle θL or the like.

In respect of energy efficiency, the laser irradiation angle θL is preferably equal to or greater than 80 degrees, more preferably equal to or greater than 85 degrees, and still more preferably 90 degrees.

In respect of facilitating the formation of the fine groove 10 and/or the protruded part 12 by the laser LS, the material of the portion in which the fine groove 10 and the protruded part 12 are provided is preferably a metal. More preferred examples of the material include soft iron (low-carbon steel having a carbon content of less than 0.3 wt %), stainless steel, a titanium alloy, and pure titanium.

In a more preferred embodiment, two or more lasers LS are used. In the embodiment of FIG. 10, a first laser LS1 and a second laser LS2 are used. After the face surface is irradiated with the first laser LS1 in the embodiment, the face surface is irradiated with the second laser LS2. An irradiation speed of the first laser LS1 is slower than that of the second laser LS2. A current of the first laser LS1 is greater than that of the second laser LS2. A frequency of the first laser LS1 is higher than that of the second laser LS2. A heating temperature by the first laser LS1 is higher than a heating temperature by the second laser LS2.

The formation method of the fine groove 10 and the protruded part 12 according to the embodiment of FIG. 10 includes a first step of forming an initial fine groove (not illustrated) by the first laser LS1, and a second step of adjusting a depth D2, surface roughness, shape, and/or color of the initial fine groove by the second laser LS2 to form the fine groove 10. The fine groove 10 having excellent dimension accuracy can be formed by using the two or more lasers LS.

Figure 11:
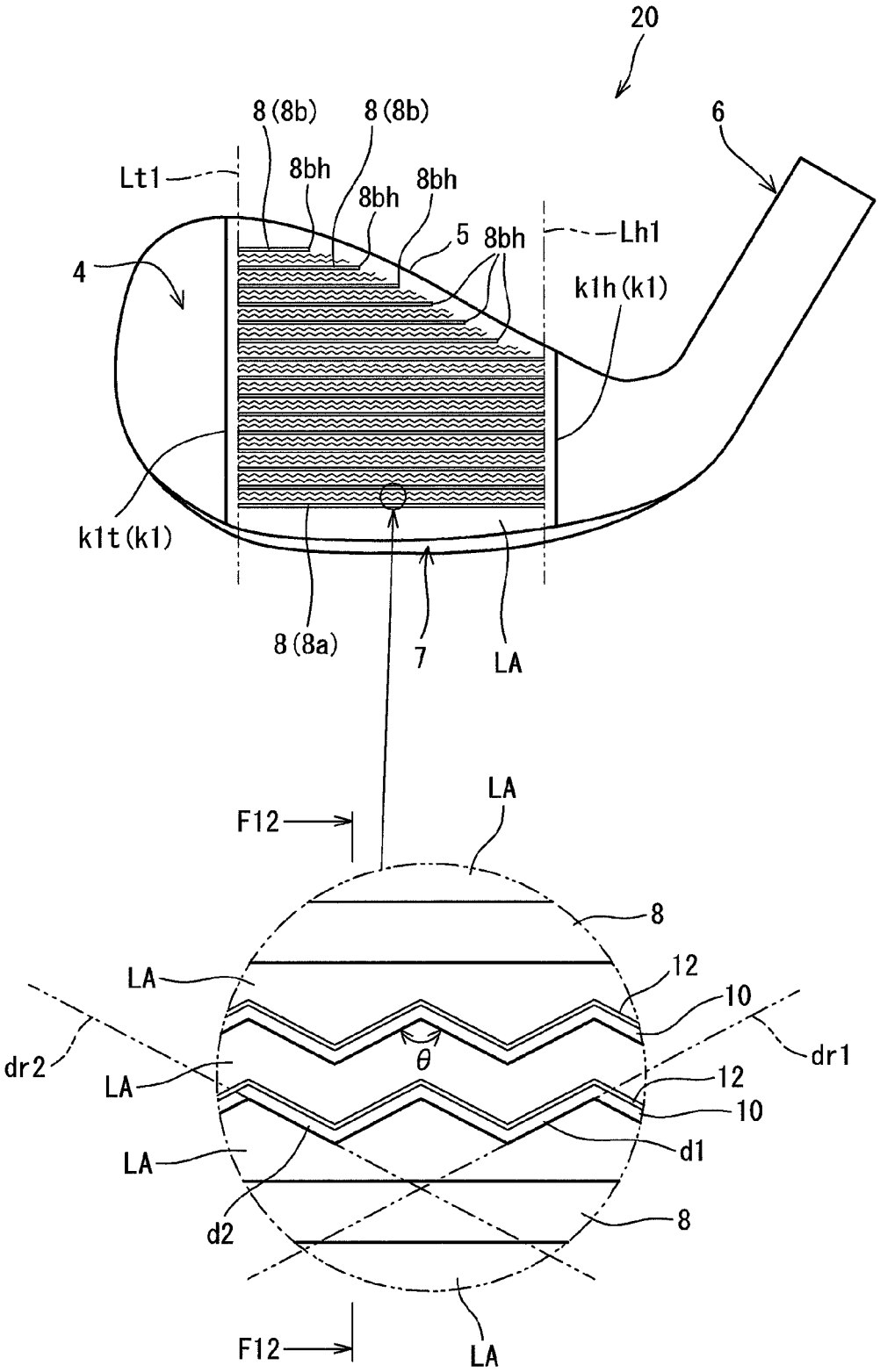
FIG. 11 is a front view of a golf club head according to an eighth embodiment.
Figure 12:
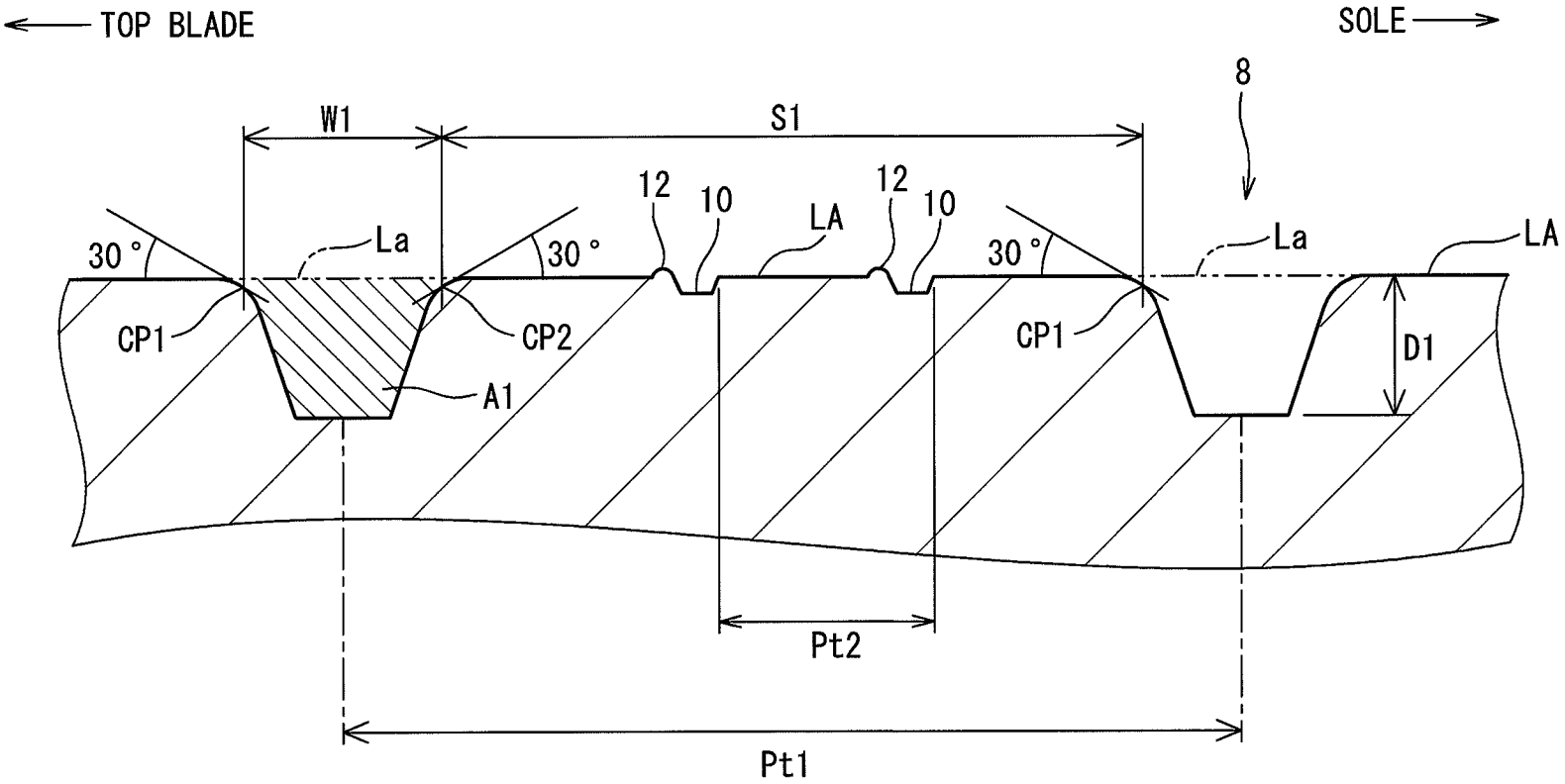
FIG. 12 is a cross-sectional view taken along line F12-F12 of FIG. 11.
Figure 13:
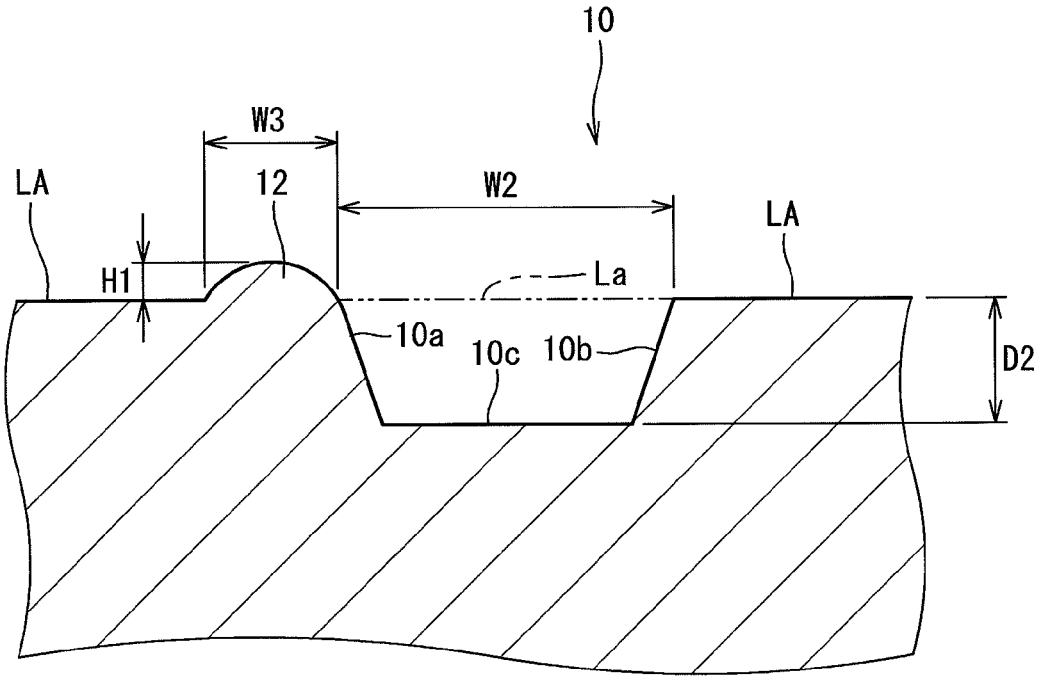
FIG. 13 is an enlarged view of a fine groove in FIG. 12.

FIG. 11 is a front view of a head 20 according to an eighth embodiment. FIG. 12 is a cross-sectional view taken along line F12-F12 of FIG. 11. FIG. 13 is a partial enlarged view of FIG. 12.

In the head 20, the protruded part 12 is provided only on the top blade 5 side of the fine groove 10. The protruded part 12 is not formed on the sole 7 side of the fine groove 10. Except for this point, the head 20 is the same as the head 2.

The provision of the protruded part 12 only on the top blade 5 side of the fine groove 10 can contribute to the increase in the backspin rate. During impact, the ball is moved on the face 4. The movement is caused by the sliding and/or rolling of the ball. The movement is produced by the inclination of the face 4, that is, the loft angle. The direction of the movement is a direction from the sole surface 7 side to the top blade 5 side. The protruded part 12 is not provided on the sole surface 7 side of the fine groove 10, and thereby the ball moving on the face 4 tends to enter into the fine groove 10. The entering tends to increase the backspin rate. Furthermore, a physical engagement effect is enhanced by the protruded part 12 provided on the top blade 5 side of the fine groove 10. Therefore, the backspin rate can be increased.

[Formation Method 2 of Fine Groove and Protruded Part]

Figure 14:
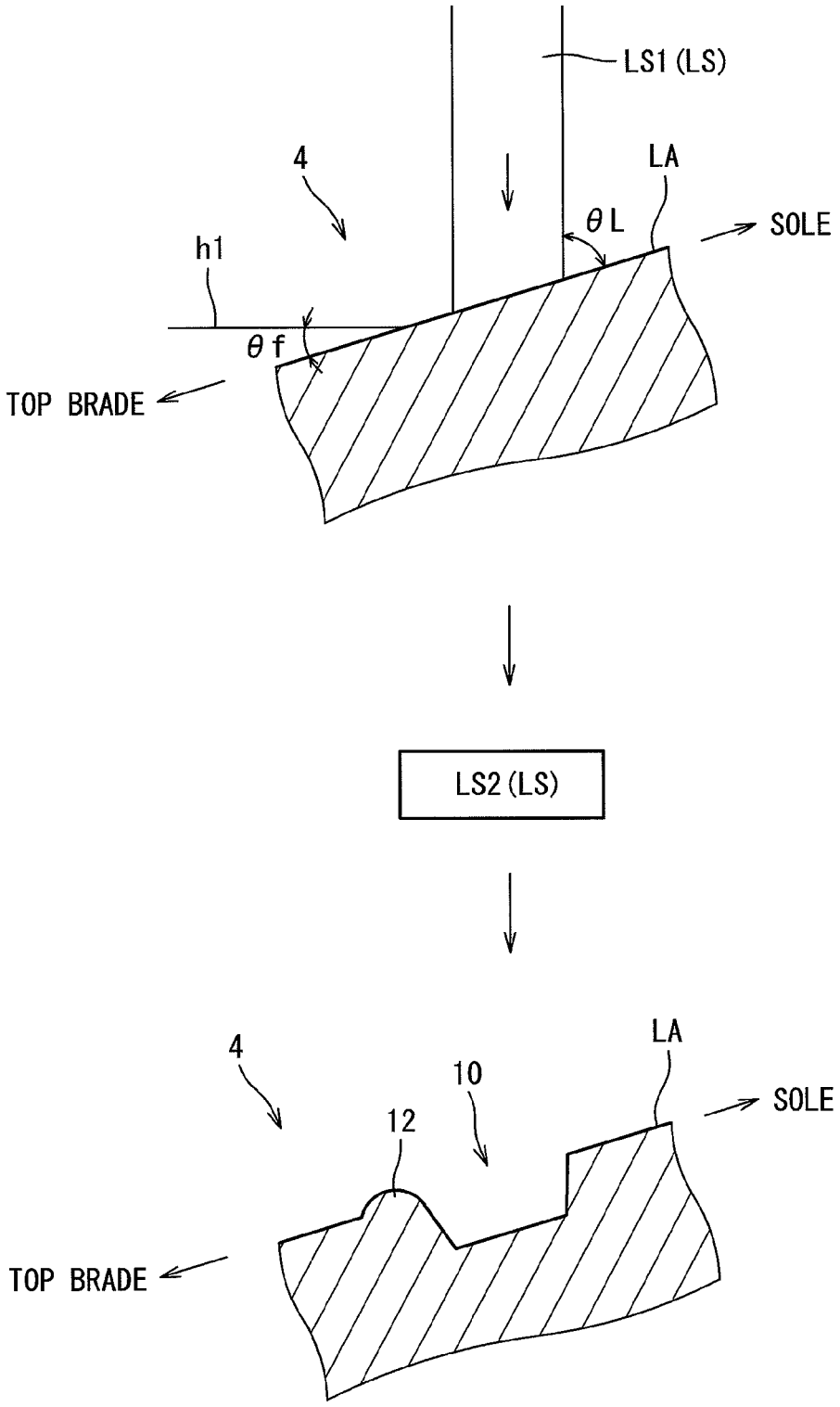
FIG. 14 describes other example of a formation method of a fine groove and a protruded part.

FIG. 14 describes a preferable formation method of the protruded part 12 in the head 20. In the formation method, the face surface is irradiated with a laser LS. The face surface (land area LA) is irradiated with the laser LS in a state where the face surface is inclined with respect to a level surface h1. The specification of the formed protruded part 12 can be adjusted by the direction of the inclination and an inclination angle θf.

In the embodiment of FIG. 14, the face 4 is irradiated with the laser LS in a state where the face 4 is inclined so that the sole surface 7 side of the face 4 is located above the top blade 5 side. A portion heated by the laser LS reaches a high temperature. The portion reaching a high temperature can be melted. The melted portion can flow. The flow is caused by gravity. The fine groove 10 is formed by the flow. Furthermore, a fluid is moved to the position of the protruded part 12 by the flow. The portion in which the protruded part 12 is formed is not irradiated with the laser LS. Therefore, the temperature of the moved fluid is lowered to solidify the fluid. The protruded part 12 is formed by the solidification. Thus, the protruded part 12 is formed by moving the portion heated by the laser LS by the action of the gravity. The protruded part 12 is selectively formed only on the top blade 5 side by the gravity. The formation of the protruded part 12 on the sole surface 7 side is prevented by the action of the gravity.

In respects of facilitating the formation of the fine groove 10 and the protruded part 12, and of forming the protruded part 12 only on the top blade 5 side, the inclination angle θf is preferably equal to or greater than 5 degrees, more preferably equal to or greater than 10 degrees, and still more preferably equal to or greater than 15 degrees. When the inclination angle θf is excessively large, the movement speed of the fluid is excessively large, which may decrease the formation accuracy of the protruded part 12. When the inclination angle θf is excessively large, the movement speed of the fluid is excessively large, which may excessively decrease the height of the protruded part 12. In these respects, the inclination angle θf is preferably equal to or less than 45 degrees, more preferably equal to or less than 40 degrees, and still more preferably equal to or less than 30 degrees. However, the inclination angle θf can be suitably adjusted in consideration of the material of the face surface and the output of the laser LS or the like.

When the inclination angle θf is set negative, the protruded part 12 can be formed only on the sole surface 7 side of the fine groove 10. In a state where the inclination angle θf is negative, the sole surface 7 side (leading edge) is located below the top blade 5.

There can also be employed a formation method of the fine groove 10 and the protruded part 12 including the steps of irradiating the face surface with the laser LS in a state where the inclination angle θf is set positive, and irradiating the face surface with the laser LS in a state where the inclination angle θf is set negative.

In respect of energy efficiency, the laser irradiation angle θL is preferably closer to 90 degrees. In respect of preventing the protruded part 12 from being irradiated with the laser LS, the laser irradiation angle θL may be less than 90 degrees. In these respects, the angle θL is preferably 45 degrees or greater and 90 degrees or less, more preferably 50 degrees or greater and 90 degrees or less, and still more preferably 60 degrees or greater and 90 degrees or less. The angle θL is an angle between the laser LS and the land area LA which is on the sole surface 7 side of the irradiation position of the laser LS. Therefore, the protruded part 12 is hardly irradiated with the laser LS by setting the angle θL to be equal to or less than 90 degrees. Therefore, the formation of the protruded part 12 can be facilitated.

Also in the embodiment of FIG. 14, the first laser LS1 and the second laser LS2 are used. After the face surface is irradiated with the first laser LS1 in the embodiment, the face surface is irradiated with the second laser LS2. An irradiation speed of the first laser LS1 is slower than that of the second laser LS2. A current of the first laser LS1 is greater than that of the second laser LS2. A frequency of the first laser LS1 is higher than that of the second laser LS2. A heating temperature by the first laser LS1 is higher than a heating temperature by the second laser LS2.

The formation method of the fine groove 10 and the protruded part 12 according to the embodiment of FIG. 14 includes a first step of forming an initial fine groove (not illustrated) using gravity by the first laser LS1, and a second step of adjusting a depth D2, surface roughness, shape, and/or color of the initial fine groove by the second laser LS2 to form the fine groove 10. The fine groove 10 having excellent dimension accuracy can be formed by using the two or more lasers LS. The protruded part 12 can be selectively formed only on the one side of the fine groove 10 by utilizing the gravity.

[Overview of Each Embodiment]

In the embodiment of FIG. 4, the first direction extending parts d1 and the second direction extending parts d2 are alternately and continuously disposed. The toe side end of the fine groove 10 reaches the straight line Lt1 (see FIG. 1). The heel side end of the fine groove 10 reaches the straight line Lh1 (see FIG. 1). Each of the fine grooves 10 is continuous from a position on the straight line Lt1 to a position on the straight line Lh1. The angle α is equal to the angle β. The length Ld1 is equal to the length Ld2. The fine groove 10 consists of the first direction extending part d1 and the second direction extending part d2. The score line groove 8 and the fine groove 10 do not cross each other. The first direction extending part d1 extends in a direction along a straight line. The second direction extending part d2 extends in a direction along a straight line.

In the embodiment of FIG. 5, the first direction extending parts d1 and the second direction extending parts d2 are alternately and continuously disposed. The toe side end of the fine groove 10 reaches the straight line Lt1 (see FIG. 1). The heel side end of the fine groove 10 reaches the straight line Lh1 (see FIG. 1). Each of the fine grooves 10 is continuous from a position on the straight line Lt1 to a position on the straight line Lh1. An angle α is less than an angle β. The length Ld1 is greater than the length Ld2. The fine groove 10 consists of the first direction extending part d1 and the second direction extending part d2. The score line groove 8 and the fine groove 10 do not cross each other. The first direction extending part d1 extends in a direction along a straight line. The second direction extending part d2 extends in a direction along a straight line.

In the embodiment of FIG. 6, the first direction extending parts d1 and the second direction extending parts d2 are alternately and continuously disposed with the round parts R disposed therebetween. The toe side end of the fine groove 10 reaches the straight line Lt1 (see FIG. 1). The heel side end of the fine groove 10 reaches the straight line Lh1 (see FIG. 1). Each of the fine grooves 10 is continuous from a position on the straight line Lt1 to a position on the straight line Lh1. The angle α is less than the angle β. The length Ld1 is greater than the length Ld2. The fine groove 10 consists of the first direction extending part d1, the second direction extending part d2, and the round part R. The score line groove 8 and the fine groove 10 do not cross each other. The first direction extending part d1 extends in a direction along a straight line. The second direction extending part d2 extends in a direction along a straight line.

In the embodiment of FIG. 7, the first direction extending parts d1 and the second direction extending parts d2 are alternately and continuously disposed with the third direction extending part d3 disposed therebetween. The toe side end of the fine groove 10 reaches the straight line Lt1 (see FIG. 1). The heel side end of the fine groove 10 reaches the straight line Lh1 (see FIG. 1). Each of the fine grooves 10 is continuous from a position on the straight line Lt1 to a position on the straight line Lh1. The angle α is equal to the angle β. The length Ld1 is equal to the length Ld2. The fine groove 10 consists of the first direction extending part d1, the second direction extending part d2, and the third direction extending part d3. The third direction extending part d3 may not be parallel to the score line groove 8. The score line groove 8 and the fine groove 10 do not cross each other. The first direction extending part d1 extends in a direction along a straight line. The second direction extending part d2 extends in a direction along a straight line. The third direction extending part d3 extends in a direction along a straight line.

In the embodiment of FIG. 8, the first direction extending parts d1 and the second direction extending parts d2 are alternately and continuously disposed with the round parts R disposed therebetween. The toe side end of the fine groove 10 reaches the straight line Lt1 (see FIG. 1). The heel side end of the fine groove 10 reaches the straight line Lh1 (see FIG. 1). Each of the fine grooves 10 is continuous from a position on the straight line Lt1 to a position on the straight line Lh1. The score line groove 8 and the fine groove 10 do not cross each other. Although the first direction is a direction almost along a straight line, the first direction has a tolerance (allowable range) of ±5 degrees. Similarly, although the second direction is a direction almost along a straight line, the second direction has a tolerance (allowable range) of ±5 degrees. Therefore, the fine groove 10 formed only by a wavelike curve also can have the first direction extending part d1 and the second direction extending part d2. When the first direction and the second direction have a range, the angle α, the angle β, and the angle θ are determined by the medium value of the range.

In the embodiment of FIG. 9, the first direction extending parts d1 and the second direction extending parts d2 are alternately disposed in the toe-heel direction with the first direction extending parts d1 and the second direction extending parts d2 separated from each other. An angle α is equal to an angle β. The length Ld1 is equal to the length Ld2. The fine groove 10 consists of the first direction extending part d1 and the second direction extending part d2. The score line groove 8 and the fine groove 10 do not cross each other. The first direction extending part d1 extends in a direction along a straight line. The second direction extending part d2 extends in a direction along a straight line.

In the embodiment of FIG. 11, the first direction extending parts d1 and the second direction extending parts d2 are alternately and continuously disposed. The toe side end of the fine groove 10 reaches the straight line Lt1. The heel side end of the fine groove 10 reaches the straight line Lh1. Each of the fine grooves 10 is continuous from a position on the straight line Lt1 to a position on the straight line Lh1. An angle α is equal to an angle β. The length Ld1 is equal to the length Ld2. The fine groove 10 consists of the first direction extending part d1 and the second direction extending part d2. The score line groove 8 and the fine groove 10 do not cross each other. The first direction extending part d1 extends in a direction along a straight line. The second direction extending part d2 extends in a direction along a straight line.

[Depth D2 of Fine Groove]

In respect of the increase in the backspin rate, the depth D2 of the fine groove 10 is preferably equal to or greater than 0.01 mm, more preferably equal to or greater than 0.015 mm, and still more preferably equal to or greater than 0.02 mm. When the depth D2 is excessively large, the variation in the backspin rate may occur. In this respect, the depth D2 is preferably less than 0.03 mm, and more preferably equal to or less than 0.025 mm.

[Width W2 of Fine Groove]

In respect of the increase in the backspin rate, the width W2 of the fine groove 10 is preferably equal to or greater than 0.1 mm, more preferably equal to or greater than 0.15 mm, and still more preferably equal to or greater than 0.2 mm. When the width W2 is excessively large, an area for forming the fine groove 10 is decreased. Accordingly, the number of the fine grooves 10 may be decreased. In this respect, the width W2 is preferably equal to or less than 0.3 mm, and more preferably equal to or less than 0.25 mm.

[Pitch Pt2 of Fine Groove]

A pitch of the fine groove 10 is shown by a double-pointed arrow Pt2 in FIG. 2. When the pitch Pt2 is excessively small, the engagement effect of the fine groove 10 may be decreased if anything. In this respect, the pitch Pt2 is preferably equal to or greater than 1.5 times the width W2, and more preferably equal to or greater than 2 times the width W2. When the number of the fine grooves 10 is excessively small, the backspin rate may be decreased. In this respect, the pitch Pt2 is preferably equal to or less than 5 times the width W2, and more preferably equal to or less than 4 times the width W2.

When the pitch Pt2 of the fine groove 10 is excessively small, the engagement effect of the fine groove 10 may be decreased if anything. In this respect, the pitch Pt2 is preferably equal to or greater than 0.3 mm, and more preferably equal to or greater than 0.4 mm. When the number of the fine grooves 10 is excessively small, the backspin rate may be decreased. In this respect, the pitch Pt2 is preferably equal to or less than 0.8 mm, more preferably equal to or less than 0.7 mm, and still more preferably equal to or less than 0.6 mm.

[Height H1 of Protruded Part]

As described above, in the embodiment, the protruded part 12 may be provided. A height of the protruded part 12 is shown by a double-pointed arrow H1 in FIG. 3. The height H1 is a height from the land area LA. The height H1 is measured along a normal line direction of the land area LA. In respect of the increase in the backspin rate, the height H1 of the protruded part 12 is preferably equal to or greater than 0.001 mm, more preferably equal to or greater than 0.003 mm, and still more preferably equal to or greater than 0.005 mm. In respect of the rules for the surface roughness, the height H1 is preferably equal to or less than 0.02 mm, more preferably equal to or less than 0.015 mm, and still more preferably equal to or less than 0.01 mm.

[First Direction]

The first direction extending part d1 extends in the direction directed to the top blade side toward the heel side. Therefore, the first direction extending part d1 is nearly perpendicular to a swing path when a swing is performed with the face opened. The first direction extending part d1 can increase the backspin when the ball is hit with the face opened. A typical example of a situation hitting the ball with the face opened is an approach shot intended to vertically raise a ball to stop the ball on a green. The backspin is preferably increased in the situation the ball is hit with the face opened. The first direction extending part d1 contributes to the increase in the backspin. A backspin increase effect when the face is opened is also referred to as a spin increase effect X in the present application.

[Second Direction]

The second direction extending part d2 extends in the direction directed to the top blade side toward the toe side. Therefore, the second direction extending part d2 is nearly perpendicular to a swing path when a swing is performed with the face closed. The second direction extending part d2 can increase the backspin when the ball is hit with the face closed. A backspin increase effect when the face is closed is also referred to as a spin increase effect Y in the present application.

It was found that the wet spin can be improved by providing the first direction extending part d1 and the second direction extending part d2. Evaluation results of examples to be described later show the improvement in the wet spin. Although the reason is not clear, the reason is guessed as follows. A thin water film is considered to be generated between the face surface and the ball to decrease the wet spin. Water flows into the fine groove 10 to suppress the formation of the water film. Furthermore, the fine groove 10 extends in two different directions, and thereby the water tends to flow in the fine groove 10. This is because either the first direction extending part d1 or the second direction extending part d2 can be brought close to the acceleration direction of the head. The water is apt to be collected to a local portion by the flow of the water in the fine groove 10. The local portion is, for example, a position where the first direction extending part d1 and the second direction extending part d2 cross each other. The water can be discharged from the collecting position. The discharge of the water can be promoted by the first direction extending part d1 and the second direction extending part d2. A water film suppressing effect can be generated based on these phenomena. The wet spin is considered to be capable of being increased by the water film suppressing effect. The extending direction of the score line groove 8, the first direction, and the second direction are different, and thereby the water film suppressing effect is considered to be capable of being further improved.

[Angle α and Angle β]

$\alpha<\beta$ is set, and thereby the spin increase effect X tends to be relatively greater than the spin increase effect Y. Therefore, when the face is opened, the backspin is effectively increased, and when the face is closed, the excessive increase in the backspin can be suppressed. Therefore, when the face is opened, a run is decreased, and the ball tends to stop near a falling point. On the other hand, when the face is closed, a moderate run can be obtained. These effects can improve the accuracy of the approach shot.

In respects of the spin increase effect X and the water film suppressing effect, the angle α is preferably equal to or greater than 5 degrees, and more preferably equal to or greater than 10 degrees. In respect of the spin increase effect X, the angle α is preferably equal to or less than 45 degrees, and more preferably equal to or less than 40 degrees.

In respects of the spin increase effect Y and the water film suppressing effect, the angle β is preferably equal to or greater than 5 degrees, more preferably equal to or greater than 10 degrees, and still more preferably equal to or greater than 20 degrees. In respect of the spin increase effect Y, the angle is preferably equal to or less than 90 degrees, more preferably equal to or less than 80 degrees, and still more preferably equal to or less than 70 degrees.

In respect of the water film suppressing effect, an angle difference (β−α) is preferably equal to or greater than 5 degrees, more preferably equal to or greater than 10 degrees, still more preferably equal to or greater than 20 degrees, and yet still more preferably equal to or greater than 30 degrees. In light of preferred values of the angles α and β, the angle difference (β−α) is preferably equal to or less than 60 degrees, more preferably equal to or less than 50 degrees, and still more preferably equal to or less than 45 degrees.

[Length Ld1 and Length Ld2]

Ld1≥Ld2 is preferably set, and Ld1>Ld2 is more preferably set. In this case, the spin increase effect X tends to be relatively greater than the spin increase effect Y. Therefore, when the face is opened, the backspin is effectively increased, and when the face is closed, the excessive increase in the backspin can be suppressed. Therefore, when the face is opened, the run is decreased, and the ball tends to stop near a falling point. On the other hand, when the face is closed, a moderate run can be obtained. These effects enable various shots, and can be improve the accuracy of the approach shot.

In respect of considering the balance between the spin increase effect X and the spin increase effect Y to enhance the accuracy of an approach, a ratio (Ld1/Ld2) is preferably equal to or greater than 1.0, more preferably equal to or greater than 1.2, preferably equal to or less than 11.5, and more preferably equal to or less than 10.0.

[Angle θ]

In respects of the spin increase effect X, the spin increase effect Y, and the water film suppressing effect, an angle between the first direction and the second direction is preferably equal to or greater than 45 degrees, more preferably equal to or greater than 60 degrees, and still more preferably equal to or greater than 90 degrees. In light of preferred values of the angles α and β, the angle θ is preferably equal to or less than 170 degrees and more preferably equal to or less than 160 degrees.

When the score line groove 8 and the fine groove 10 cross each other, the edge of the score line groove 8 is eliminated by the fine groove 10. Therefore, a backspin effect caused by the edge of the score line groove 8 may be decreased. The score line groove 8 and the fine groove 10 do not cross each other, and thereby the backspin can be increased.

When the fine grooves 10 cross each other, the edge of the fine groove 10 is eliminated by the other fine groove 10. Therefore, the backspin effect caused by the edge of the fine groove 10 may be decreased. The fine grooves 10 do not cross each other, and thereby the backspin can be increased.

The extending direction of the fine groove 10 can be set perpendicular to various swing paths by providing the round part R. Therefore, the increase in the backspin in the various swing paths is enabled. Similarly, the round part R can be adapted for various face opening angles. Therefore, the increase in the backspin in the various face opening angles is enabled. It is guessed that the round part R can play a role in storing the water flowing into the fine groove 10. Therefore, the round part R can contribute to the water film suppressing effect.

[Area Sa]

An area Sa is defined in the present application. An area of a portion sandwiched by a plurality of score line grooves 8 is Sa. The area Sa is an area in a plan view of the face surface. In the embodiment of FIG. 1, the area Sa is an area of a portion surrounded by the following lines (a) to (f). The occupied area of the score line groove 8 and the occupied area (area Sb) of the fine groove 10 are included in the area Sa.

(a) the straight line Lt1

(b) the straight line Lh1

(c) the score line groove 8 (non-longest line 8*b*) located closest to the top blade side (d) the score line groove 8 (longest line 8*a*) located closest to the sole side (e) straight lines connecting heel side ends 8*bh* of the non-longest lines 8*b* adjacent to each other (not illustrated)

(f) a straight line connecting a heel side end 8*bh* of the non-longest line 8*b* located closest to the sole side to a heel side end of the longest line 8*a* located closest to the top blade side (not illustrated)

[Area Sb]

An area Sb is defined in the present application. An area (total area) of the fine groove 10 is Sb. The area Sb is an area of the face surface in a plan view. When the protruded part 12 is provided, the occupied area of the protruded part 12 is included in the area Sb.

A width of the protruded part 12 is shown by a double-pointed arrow W3 in FIG. 3. Particularly, in respect of suppressing the variation of the wet spin, W3/W2 is preferably equal to or greater than 0.1, and more preferably equal to or greater than 0.2. In respect of making Sb/Sa appropriate, W3/W2 is preferably equal to or less than 0.7, and more preferably equal to or less than 0.6.

In respect of enhancing the effect by the fine groove 10, Sb/Sa is preferably equal to or greater than 0.14, and more preferably equal to or greater than 0.17. When Sb/Sa is excessively large, a contact area between the ball and the face surface at impact is decreased. When the contact area is excessively small, the spin rate is decreased. In this respect, Sb/Sa is preferably equal to or less than 0.44, and more preferably equal to or less than 0.35.

In order to facilitate the understanding, in the drawings of the present application, the width of the fine groove 10 is comparatively narrowly drawn. In these drawings, the area Sb is smaller than in reality.

The angle θ, the angle α, the angle β, the area Sa, and the area Sb are values as viewed from the front of the face surface (land area LA). The angle θ, the angle α, and the angle β are judged in a plane including the land area LA.

In respect of setting Sb/Sa to a preferred value, the number of the fine grooves 10 provided between the adjacent score line grooves 8 is preferably equal to or greater than 2, more preferably equal to or greater than 3, and still more preferably equal to or greater than 4. In respect of setting Sb/Sa to a preferred value, the number of the fine grooves 10 provided between the adjacent score line grooves 8 is preferably equal to or less than 8, more preferably equal to or less than 7, still more preferably equal to or less than 6, and yet still more preferably equal to or less than 5.

In respect of the golf rules, the depth D1 (mm) of the score line groove is preferably equal to or less than 0.508 (mm), more preferably equal to or less than 0.480 (mm), and still more preferably equal to or less than 0.460 (mm). When the groove depth D1 is excessively small, the area A1 of the cross section of the groove may be decreased to decrease the spin performance. In this respect, the groove depth D1 is preferably equal to or greater than 0.100 (mm), more preferably equal to or greater than 0.200 (mm), and still more preferably equal to or greater than 0.250 (mm).

EXAMPLES

Hereinafter, the effects of the present invention will be clarified by examples. However, the present invention should not be interpreted in a limited way based on the description of the examples.

Two tests were performed. Examples A to G were evaluated in a test 1. Examples 1 to 3 and comparative examples 1 and 2 were evaluated in a test 2.

[Test 1]

The test 1 was carried out by using examples A to G and a reference club.

Example A

A head (before forming a score line groove) of "Cleveland CG16 Forged Wedge" (trade name) manufactured by DUNLOP SPORTS CO., LTD. was prepared. The score line groove was formed on the head by using a CNC processing machine. Next, a fine groove and a protruded part were formed by a laser beam machine. The kind of a laser was a YAG laser. The real loft angle of the head was set to 58 degrees. A grip and a shaft were mounted to the head to obtain a test club. The grip was Tour Velvet Rubber manufactured by Golf Pride Company. The shaft was Dynamic Gold manufactured by True Temper Sports, Inc.

A fine groove 10 and a protruded part 12 were formed based on the embodiment of FIG. 10. Two lasers were used in laser processing. After a face surface was irradiated with a first laser, the face surface was irradiated with a second laser. The formation of the protruded part was achieved by the first laser. The color and depth D2 of the fine groove were adjusted by the second laser. The specifications of the lasers were as follows.

[First Laser]

Irradiation Speed (mm/sec): 300
Current (A): 20
Frequency (kHz): 10

[Second Laser]

Irradiation Speed (mm/sec): 500
Current (A): 15
Frequency (kHz): 5

The irradiation speed is a movement speed of a position irradiated with the laser. The slower the irradiation speed is, the larger irradiation energy per unit area is, and the higher a temperature is. In this example, the irradiation speed of the first laser was set to be slower than that of the second laser.

A head of example A was obtained as described above. The fine groove of example A was in a form as shown in FIG. 4. Five fine grooves were formed between the adjacent score line grooves. A length Ld1 and a length Ld2 were set to 1 mm. The specifications and evaluation results of the head are shown in the following Table 1. "INFINITE FOCUS optical 3D Measurement Device G4F" (trade name) manufactured by Alicona Imaging GmbH was used for shape measurement for the fine groove and the protruded part.

Examples B to G

Heads and clubs of examples B to G were obtained in the same manner as in example A except for the specifications shown in Table 1. Fine grooves of examples B, C, D, E, and G are in forms similar to that of FIG. 5. A fine groove of example F is in a form similar to that of FIG. 4. These specifications and evaluation results are shown in the following Table 1.

[Reference Club]

A reference club was obtained in the same manner as in example A except that all fine grooves were made straight in parallel with a score line groove.

[Evaluation Method of Backspin in Test 1]

Ten golf players having a handicap of 0 to 9 made evaluations as testers. "SRIXON Z-STAR2" (trade name) manufactured by DUNLOP SPORTS CO., LTD. was used as a ball. A hit ball point and a target point were set, and the testers hit balls placed on a fairway with a half shot. A distance between the hit ball point and a cup located at the target point was set to 30 yards. A backspin rate immediately after hitting was measured. "TrackMan" (trade name) manufactured by ISG A/S Denmark was used for the measurement. Each of testers hit balls ten times with each of the clubs in each of three face states. The three face states are a square face, an open face, and a close face. In the square face, a shot was carried out with a face directed toward a target. In the open face, a shot was carried out with a face opened by about 30 degrees. In the close face, a shot was carried out with a face closed by about 10 degrees. The average values of all the data were calculated. The difference of backspin in comparison to the reference club is shown in each of sections of "backspin in square face", "backspin in open face", and "backspin in close face". These values are rounded off.

The test 1 showed that the spin increase effect X is comparatively higher than the spin increase effect Y. The result of the test 1 shows that various backspins are obtained by opening or closing the face. This result shows high controllability.

TABLE 1

| Results of test 1 | | | | | | | |
|---|---|---|---|---|---|---|---|
| | Example A | Example B | Example C | Example D | Example E | Example F | Example G |
| Depth D2 of fine groove (mm) | 0.014 | 0.014 | 0.014 | 0.014 | 0.014 | 0.014 | 0.014 |
| Width W2 of fine groove (mm) | 0.15 | 0.15 | 0.15 | 0.15 | 0.15 | 0.15 | 0.15 |
| Pitch Pt2 of fine groove (mm) | 0.508 | 0.508 | 0.508 | 0.508 | 0.508 | 0.508 | 0.508 |
| Angle α (degree) | 5 | 5 | 5 | 24 | 24 | 45 | 45 |
| Angle β (degree) | 5 | 45 | 90 | 45 | 90 | 45 | 90 |
| Angle θ (degree) | 170 | 130 | 85 | 111 | 66 | 90 | 45 |
| Crossing of score line groove and fine groove | Non-existence | Non-existence | Non-existence | Non-existence | Non-existence | Non-existence | Non-existence |
| Ld1/Ld2 | 1.0 | 8.1 | 11.5 | 1.7 | 2.5 | 1.0 | 1.5 |
| Sb/Sa | 0.26 | 0.26 | 0.26 | 0.26 | 0.26 | 0.26 | 0.26 |
| Backspin in square face (rpm) | +200 | +100 | +50 | +50 | 0 | +50 | −50 |
| Backspin in open face (rpm) | +100 | +200 | +300 | +250 | +300 | +50 | +150 |
| Backspin in close face (rpm) | 0 | +50 | −50 | 0 | −50 | −200 | −150 |

[Test 2]

The test 2 was carried out by using examples 1 to 3 and comparative examples 1 and 2.

Examples 1 to 3

Heads and clubs of examples 1 to 3 were obtained in the same manner as in example A except for specifications shown in Table 2. These specifications and evaluation results are shown in the following Table 2.

Comparative Example 1

A head and club of comparative example 1 were obtained in the same manner as in example A except that a fine groove was not provided. The specifications and evaluation results are shown in the following Table 2.

Comparative Example 2

Figure 15:
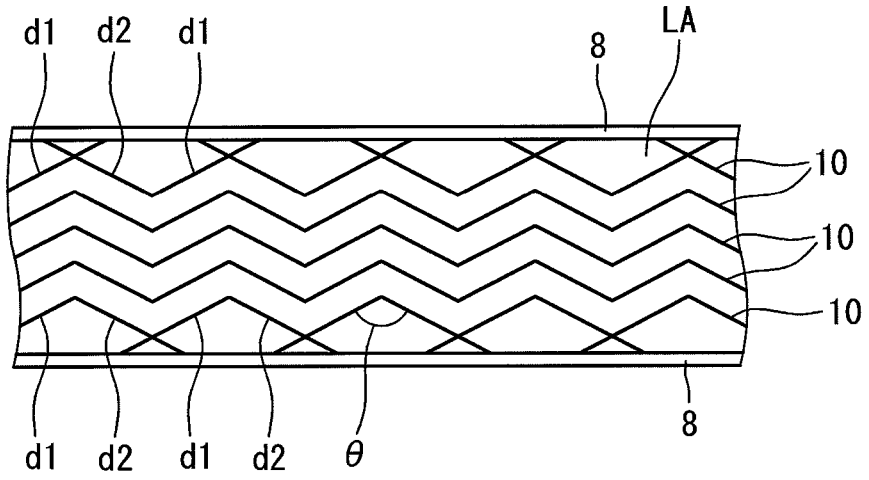
FIG. 15 is a partial enlarged view of a face surface of comparative example 2.

Example 1 was changed. An aspect of comparative example 2 is shown in FIG. 15. A first direction extending part d1 and second direction extending part d2 of a fine groove 10 adjacent to a score line groove 8 were extended, and the fine groove 10 crossed the score line groove 8. A head and club of comparative example 2 were obtained in the same manner as in example 1 except for above. The specifications and evaluation results are shown in the following Table 2.

Examples 4 to 8

Heads and clubs of examples 4 to 8 were obtained in the same manner as in example A except for specifications shown in Table 3. These specifications and evaluation results are shown in the following Table 3.

[Evaluation Method of Actual Hitting Dry Spin]

Ten golf players having a handicap of 0 to 9 made evaluations as testers. "SRIXON Z-STAR2" (trade name) manufactured by DUNLOP SPORTS CO., LTD. was used as a ball. A hit ball point and a target point were set, and the testers hit balls placed on a fairway with a half shot. A distance between the hit ball point and a cup located at the target point was set to 30 yards. A shot was carried out with the face opened by about 30 degrees. A backspin rate immediately after hitting was measured. "TrackMan" (trade name) manufactured by ISG A/S Denmark was used for the measurement. Each of testers hit balls ten times with each of the clubs. The average values of data are shown in an "actual hitting dry spin" section of the following Table 2.

[Evaluation Method of Actual Hitting Wet Spin]

Actual hitting wet spin was measured in the same manner as in the actual hitting dry spin except that a wet paper was attached to a face surface. The average values of data are shown in an "actual hitting wet spin" section of the following Table 2.

"Sontara" (trade name) manufactured by E.I. du Pont de Nemours and Company was used as the wet paper. The thickness of the wet paper is equal to or less than 1 mm, and the material thereof is wood pulp and polyester. The paper was slit, and the paper was used with the paper further wetted with water. A condition equivalent to that of the existence of a uniform water film on the face surface can be reproduced with accuracy by using the wet paper. A rough condition can be reproduced with accuracy by the wet paper.

[Evaluation Method of M/C Dry Spin]

A swing robot was used. A club was set to the robot so that the face was opened by 30 degrees with respect to a swing path. The swing robot hit balls ten times with each of the clubs. Data of dry spin in the robot were obtained in the same manner as in the actual hitting dry spin except for above. The average values of data are shown in an "M/C dry spin" section of the following Table 2.

[Evaluation Method of M/C Wet Spin]

A swing robot was used. M/C wet spin was measured in the same manner as in the M/C dry spin except that the wet paper was attached to the face. The average values of data are shown in an "M/C wet spin" section of the following Table 2.

TABLE 2

| Results of test 2 | | | | | |
|---|---|---|---|---|---|
| | Example 1 | Example 2 | Example 3 | Comparative example 1 | Comparative example 2 |
| Depth D2 of fine groove (mm) | 0.014 | 0.014 | 0.014 | — | 0.014 |

TABLE 2-continued

| Results of test 2 | | | | | |
|---|---|---|---|---|---|
| | Example 1 | Example 2 | Example 3 | Comparative example 1 | Comparative example 2 |
| Width W2 of fine groove (mm) | 0.15 | 0.15 | 0.15 | — | 0.15 |
| Pitch Pt2 of fine groove (mm) | 0.508 | 0.508 | 0.508 | — | 0.508 |
| Angle α (degree) | 10 | 30 | 45 | — | 10 |
| Angle β (degree) | 10 | 60 | 90 | — | 10 |
| Angle θ (degree) | 160 | 90 | 45 | — | 160 |
| Crossing of score line groove and fine groove | Non-existence | Non-existence | Non-existence | — | Existence |
| Ld1/Ld2 | 1.0 | 1.2 | 1.5 | — | 1.0 |
| Sb/Sa | 0.26 | 0.26 | 0.26 | — | 0.26 |
| M/C wet spin (rpm) | 5380 | 5530 | 5100 | 4600 | 4750 |
| M/C dry spin (rpm) | 7250 | 7320 | 7200 | 6700 | 6900 |
| M/C wet spin standard deviation | 340 | 370 | 420 | 450 | 580 |
| Actual hitting wet spin (rpm) | 5380 | 5850 | 5100 | 4820 | 5080 |
| Actual hitting dry spin (rpm) | 7310 | 7680 | 6740 | 7150 | 6850 |

TABLE 3

| Results of test 2 | | | | | |
|---|---|---|---|---|---|
| | Example 4 | Example 5 | Example 6 | Example 7 | Example 8 |
| Depth D2 of fine groove (mm) | 0.014 | 0.014 | 0.014 | 0.014 | 0.014 |
| Width W2 of fine groove (mm) | 0.08 | 0.10 | 0.13 | 0.20 | 0.25 |
| Pitch Pt2 of fine groove (mm) | 0.508 | 0.508 | 0.508 | 0.508 | 0.508 |
| Angle α (degree) | 10 | 10 | 10 | 10 | 10 |
| Angle β (degree) | 10 | 10 | 10 | 10 | 10 |
| Angle θ (degree) | 160 | 160 | 160 | 160 | 160 |
| Crossing of score line groove and fine groove | Non-existence | Non-existence | Non-existence | Non-existence | Non-existence |
| Ld1/Ld2 | 1.0 | 1.0 | 1.0 | 1.0 | 1.0 |
| Sb/Sa | 0.14 | 0.17 | 0.23 | 0.35 | 0.44 |
| M/C wet spin (rpm) | 5250 | 5330 | 5410 | 5390 | 5300 |
| M/C dry spin (rpm) | 7150 | 7280 | 7190 | 7250 | 7200 |
| M/C wet spin standard deviation | 510 | 400 | 310 | 330 | 510 |
| Actual hitting wet spin (rpm) | 5120 | 5330 | 5710 | 5410 | 5300 |

TABLE 3-continued

| Results of test 2 | | | | | |
|---|---|---|---|---|---|
| | Example 4 | Example 5 | Example 6 | Example 7 | Example 8 |
| Actual hitting dry spin (rpm) | 6830 | 7250 | 7320 | 7440 | 7200 |

As shown in Table 2, in examples, the difference between the wet spin and the dry spin is small. In examples, the standard deviation of the wet spin is small. It is known that the variation in the wet spin is particularly apt to occur in an iron shot. The variation in the wet spin generates flyer in a shot from a rough, for example, which is apt to lead to a big miss shot. For example, the accuracy of the approach from the rough is decreased by the variation in the wet spin. The variations have a significant influence on the making of scores. The variation in the wet spin is suppressed by the present example. The suppression can contribute to the improvement in the scores.

When example 1 is compared with comparative example 2, the backspin of example 1 is greater than that of comparative example 2. Since the score line groove and the fine groove do not cross each other in example 1, example 1 has excellent backspin performance.

As shown in Table 3, particularly, the variation in the wet spin can be effectively suppressed by appropriately setting Sb/Sa.

The advantages of the present invention are apparent from these results.

The present invention can be applied to all golf club heads including the score line groove. The present invention can be used for an iron type golf club head, a wood type golf club head, a utility type golf club head, a hybrid type golf club head, and a putter type golf club head or the like.

The description hereinabove is merely for an illustrative example, and various modifications can be made in the scope not to depart from the principles of the present invention.

What is claimed is:

1. A golf club head comprising a face, wherein the face has a plurality of score line grooves, a plurality of fine grooves, and a land area;

a depth of the fine groove is less than 0.03 mm;

a width of the fine groove is 0.1 mm or greater and 0.3 mm or less;

a pitch of the fine groove is 0.3 mm or greater and 0.8 mm or less;

the fine groove has a first direction extending part extending in a first direction and a second direction extending part extending in a second direction;

the first direction is a direction directed to a top blade side toward a heel side;

the second direction is a direction directed to the top blade side toward a toe side; and the score line groove and the fine groove do not cross each other.

2. The golf club head according to claim 1, wherein when an absolute value of an angle between an extending direction of the score line groove and the first direction is defined as α, and an absolute value of an angle between the extending direction of the score line groove and the second direction is defined as β, $\alpha \leq \beta$ is set.

3. The golf club head according to claim 2, wherein the angle α is 5 degrees or greater and 45 degrees or less, and the angle β is 5 degrees or greater and 90 degrees or less.

4. The golf club head according to claim 2, wherein the angle β is greater than the angle α.

5. The golf club head according to claim 1, wherein the fine groove consists of the first direction extending part and the second direction extending part, and an angle θ between the first direction and the second direction is 45 degrees or greater and 170 degrees or less.

6. The golf club head according to claim 1, wherein the fine grooves do not cross each other.

7. The golf club head according to claim 1, further comprising a round part connecting the first direction extending part to the second direction extending part.

8. The golf club head according to claim 1, wherein when an area of a portion sandwiched by the plurality of score line grooves is defined as Sa, and an area of the fine groove is defined as Sb, Sb/Sa is 0.14 or greater and 0.44 or less.

9. The golf club head according to claim 1, wherein the fine groove is formed by a laser.

10. The golf club head according to claim 1, further comprising a protruded part protruded from the land area, wherein the protruded part extends along the fine groove.

11. The golf club head according to claim 10, wherein the protruded part is adjacent to the fine groove.

12. The golf club head according to claim 11, wherein the protruded part is provided on the top blade side and sole side of the fine groove.

13. The golf club head according to claim 11, wherein the protruded part is provided only on the top blade side of the fine groove.

14. The golf club head according to claim 11, wherein when a width of the protruded part is defined as W3, and a width of the fine groove is defined as W2, W3/W2 is 0.1 or greater and 0.7 or less.

15. The golf club head according to claim 1, wherein when a length of the first direction extending part is defined as Ld1, and a length of the second direction extending part is defined as Ld2, the length Ld1 is greater than the length Ld2.

16. The golf club head according to claim 15, wherein Ld1/Ld2 is 1.2 or greater and 11.5 or less.

17. The golf club head according to claim 1, wherein the first direction extending parts and the second direction extending parts are alternately and continuously disposed.

18. The golf club head according to claim 1, the first direction extending parts and the second direction extending parts are alternately disposed in the toe-heel direction with the first direction extending parts and the second direction extending parts separated from each other.

* * * * *